United States Patent [19]

Carter

[11] Patent Number: 4,836,798

[45] Date of Patent: Jun. 6, 1989

[54] ZERO INSERTION SOCKET WITH NORMALLY CLOSED CONTACTS

[75] Inventor: Clyde T. Carter, Shermans Dale, Pa.

[73] Assignee: Wells Electronics, Inc., South Bend, Ind.

[21] Appl. No.: 135,731

[22] Filed: Dec. 21, 1987

[51] Int. Cl.[4] ..... H01R 13/62

[52] U.S. Cl. ..... 439/268

[58] Field of Search ..... 439/266, 268, 269, 259, 439/262–265

[56] References Cited

U.S. PATENT DOCUMENTS

| | | | |
|---|---|---|---|
| 3,763,459 | 10/1973 | Millis | 439/264 |
| 4,343,524 | 8/1982 | Bright et al. | 439/268 |
| 4,381,130 | 4/1983 | Sprenkle | 439/268 |
| 4,468,072 | 8/1984 | Sadigh-Beehzadi | 439/266 |

FOREIGN PATENT DOCUMENTS

| | | | |
|---|---|---|---|
| 84/00256 | 1/1984 | PCT Int'l Appl. | 439/266 |

*Primary Examiner*—Joseph H. McGlynn
*Attorney, Agent, or Firm*—James D. Hall

[57] ABSTRACT

A zero insertion force socket using normally closed contacts and three adjacently overlying plates. Upon lifting the activating arm, a cammed cylinder is rotated which pushes the middle plate and pulls the top plate to thereby open the prongs of the contact for component lead insertion therebetween. Upon the activating arm being moved back into its original position the cammed cylinder rotates and the middle plate shifts back to its original position under the influence of a contact prong closing about the component lead as the top plate shifts back to its original position under the influence of the cammed cylinder.

5 Claims, 7 Drawing Sheets

10
12
14
16
18
20
26
28
30
32
33
34
36
38
40
42
44
46
50
54
56
57
58
60
62
64
66
68
70
72
74
76
78
80
82
84
86
92
93
94
95
96
97
98
100
102
104
106
110
112
114
116
118
120
122
7.
8.

ZERO INSERTION SOCKET WITH NORMALLY CLOSED CONTACTS

SUMMARY OF THE INVENTION

This invention relates to a zero insertion force (ZIF) socket for connecting electrical components to a circuit board and will have application to a ZIF socket having normally closed contacts.

Heretofore, ZIF sockets used to connect electrical components, such as integrated circuits, to a circuit board have used a normally open contact arrangement. Such a socket is described in U.S. Pat. No. 3,763,459. One problem associated with the use of normally open contacts is due to the constant force required to maintain the contacts in a closed position. This force requirement creates excessive stress upon the plastic socket parts which may eventually break, or worse, weaken so as to cryptically disconnect the contact from the component lead.

The ZIF socket of this invention eliminates the above problems by using a one piece normally closed contact. The contact is designed such that the only time force is exerted by the plastic socket parts is during the brief time required to open the contacts and insert the component leads. The elimination of force required to secure the component leads reduces socket wear or breakage. Further, the use of normally closed contacts insures a stable electrical and mechanical connection to a component lead.

Accordingly, it is an object of this invention to provide for a novel and unique ZIF socket.

Another object of this invention is to provide for a ZIF socket having normally closed contacts.

Another object of this invention is to provide for a ZIF socket which places less stress on the plastic socket parts.

A further object of this invention is to provide for a ZIF socket that can be produced economically.

Further objects of this invention will become apparent upon a reading of the following description taken along with the accompanying drawings.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
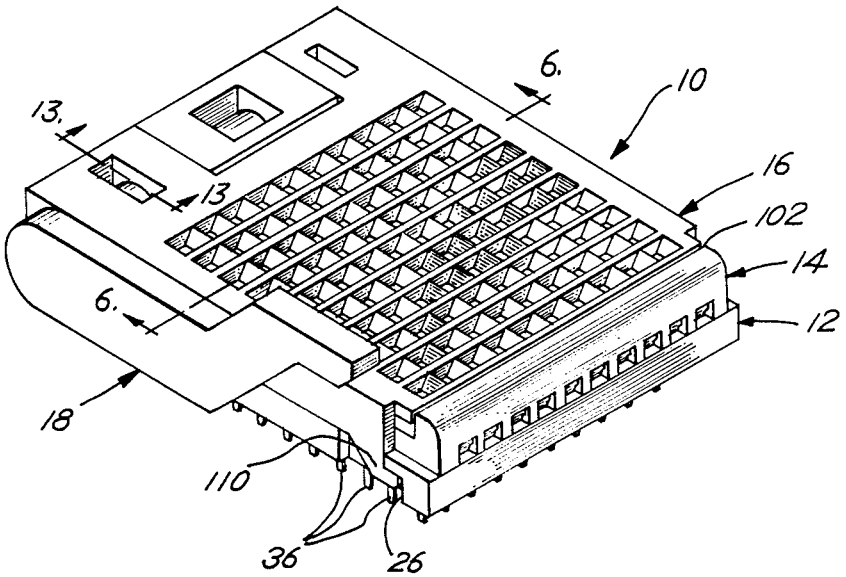
FIG. 1 is a perspective view of the socket of this invention.

The preferred embodiment herein described is not intended to be exhaustive or to limit the invention to the precise form disclosed. Rather, it is chosen and described to enable others skilled in the art to utilize its teachings.

Referring now to the drawings, the zero insertion force (ZIF) socket 10 depicted in FIGS. 1–14 includes base member 12, middle plate 14, top 16 and actuator 18 all preferably formed of a molded plastic.

Figure 3:
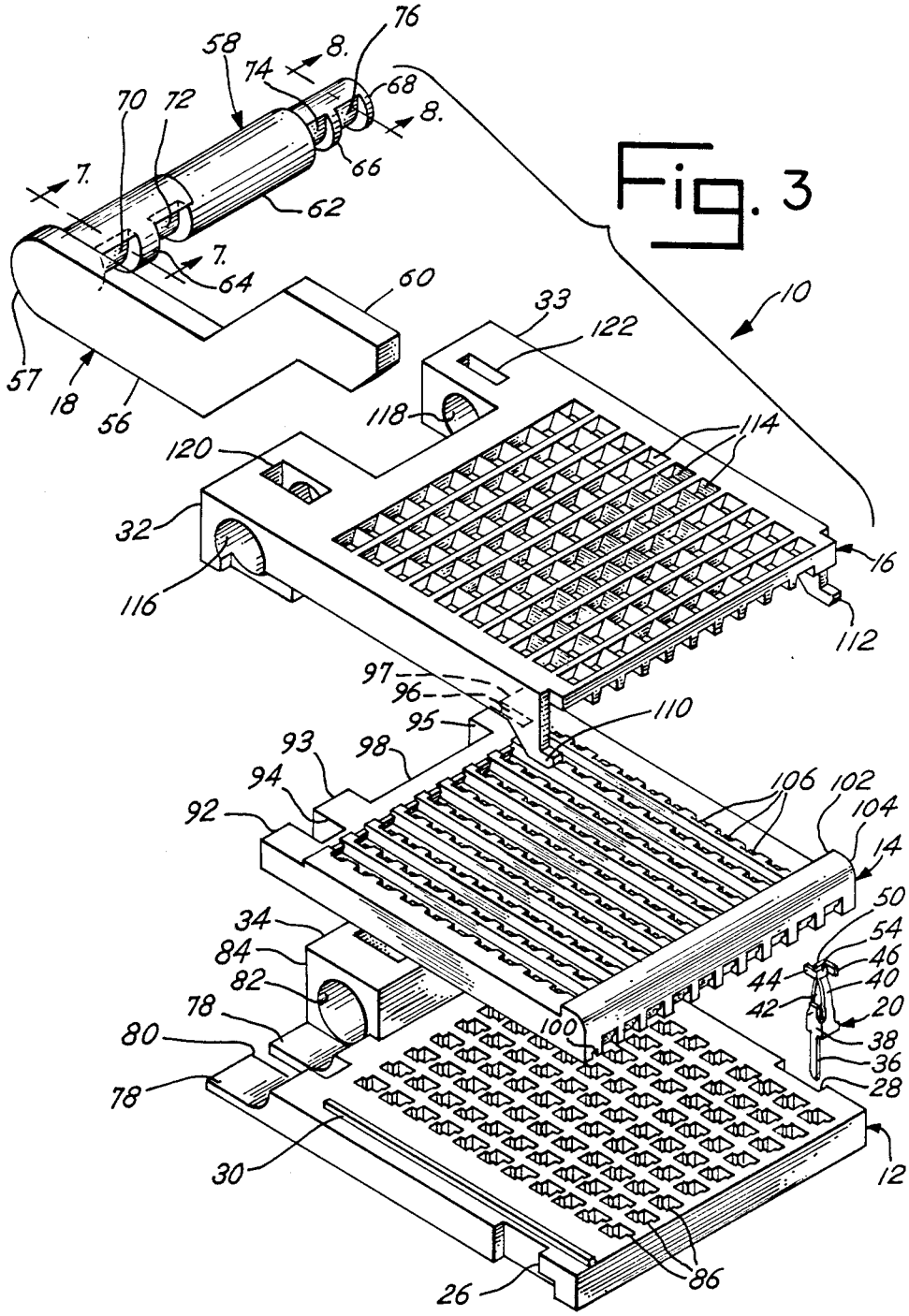
FIG. 3 is an exploded view of the socket with one contact shown.
Figure 4:
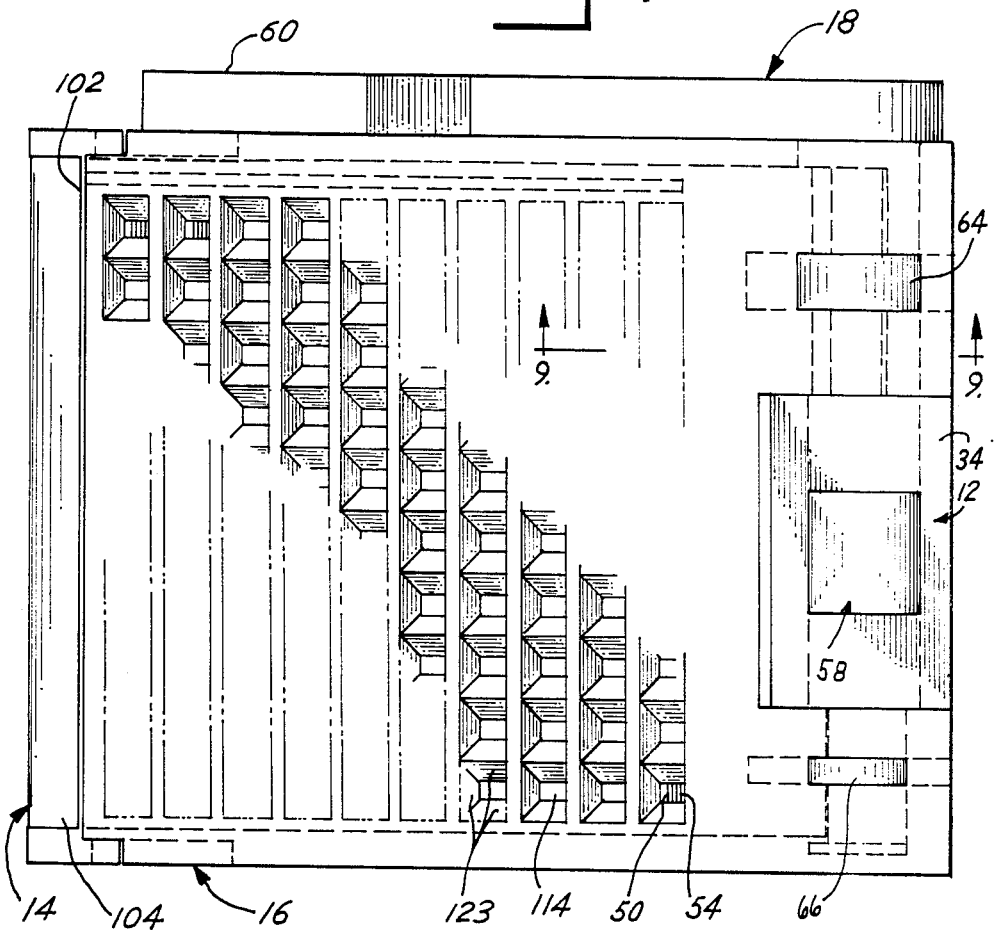
FIG. 4 is a top plan view of the socket.
Figure 6:
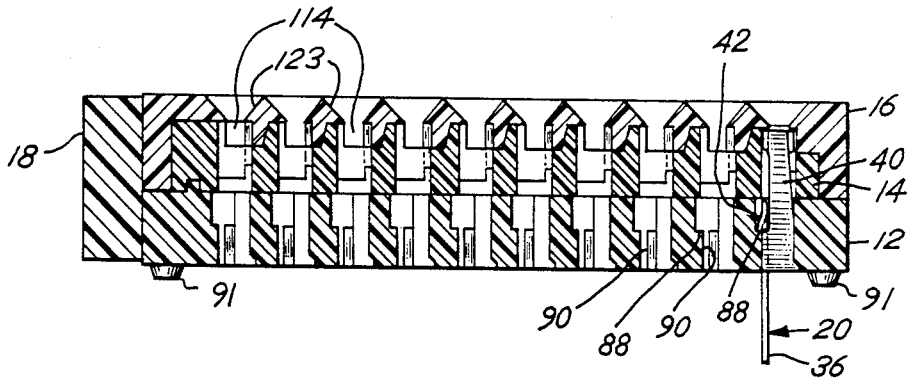
FIG. 6 is a sectional view taken along line 6—6 of FIG. 1.

Base member 12, as shown in FIG. 3 includes a support housing 34. Housing 34 defines a through bore 82 which accommodates a camming cylinder 58 of actuator 18. Base member 12 also includes a pair of spaced end flanges 78 which define a notch therebetween to accommodate cam 64 of actuator 18. A second pair of flanges (one flange 79 shown in FIG. 12) also defining a notch (not shown) are positioned at the opposite end of housing 34 (and are similar to flanges 78 and notch 80) to accommodate cam 68 of actuator 18. A straight faced guide rail 30 is formed on plate 12 as shown. Base member 12 also defines a plurality of openings 86 which, as best shown in FIG. 6, includes a narrow lower portion 90 in communication with a widened upper portion defined by ledge 88. Corner located standoffs 91 extend from the bottom of base member 12 to maintain a constant distance between plate 12 and a supporting surface. Base 12 further includes L-shaped notches 26 and 28 (only one fully shown).

Figure 10:
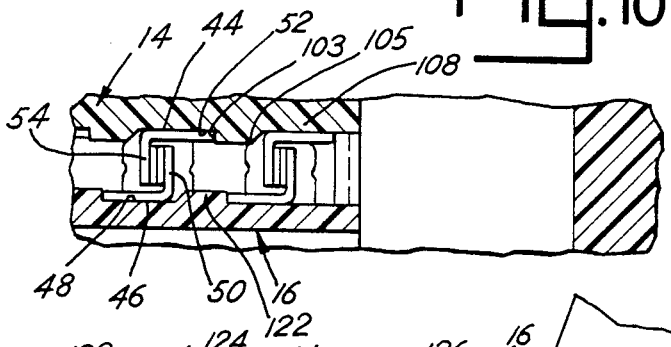
FIG. 10 is a fragmented sectional view taken along line 10—10 of FIG. 9.
Figure 11:
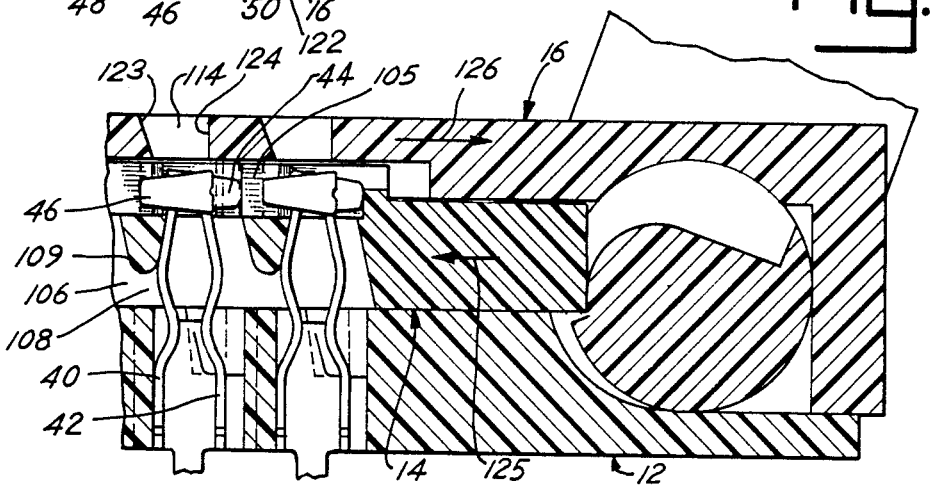
FIG. 11 is a fragmented sectional view of the socket similar to FIG. 9 with the contacts shown in their open position.
Figure 12:
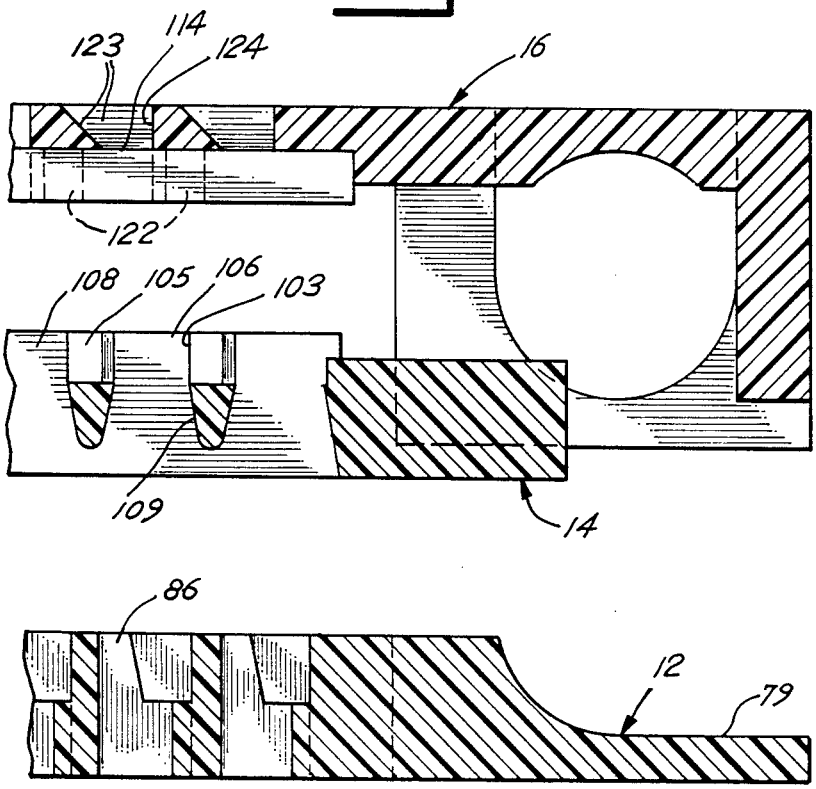
FIG. 12 is an exploded view of FIG. 9 with the contact parts omitted for clarity.

Middle plate 14 includes flanges 92 and 93 which define notch 94 and flanges 95 and 97 which define notch 96. Flanges 93 and 95 are spaced to define a center notch 98 which accommodates housing 34 of base member 12. A groove 100 is defined in the plate 14 and complementally fits rail 30 to prevent side to side movement between plates 12 and 14. An upright stop 102 is formed at end 104 of plate 14. Plate 14 defines a plurality of openings 106 which are aligned with openings 86 of base member 12 and are shaped as shown in FIGS. 6 and 19–12. Each opening 106 is defined by wall 108, (FIGS. 6 and 12) and downturned radial wall portion 109. Wall 108 includes at spaced intervals protrusions 105 having an edge 103 being substantially perpendicular to side wall 108 (FIG. 10).

Top 16 includes formed integral supports 32 and 33 which define bores 116 and 118 respectively. Top 16 also includes L-shaped protrusions 110 and 112 which mate with notches 26 and 28 of base member 12 to slidably secure the top to the base member with plate 14 slidably positioned therebetween. A notch or squared opening 120 is defined in support 32 and communicates with bore 116. Likewise, support 33 defines a notch or squared opening 122 which communicates with bore 118. Top 16 further defines openings 14 which are aligned with openings 106 of plate 14 and are shaped as shown in FIG. 6 and FIGS. 9–12. Openings 114 are defined by three converging walls 123 and one vertical wall 124. Protrusions 122 extend into openings 114 and are shaped substantially like protrusions 105 of plate 14. FIG. 12 has been included to more clearly depict the shape of the overlying openings in plates 12, 14, and 16.

As is shown in the figures, contact 20 is preferably formed from a single piece of electrically conductive metal and includes a lead leg 36 and a head 38. Head 38 is offset horizontally from leg 36 and includes spaced resilient prongs 40, 42 which terminate in oppositely extending ears 44, 46 respectively. Prongs 40 and 42 are preferably formed so as to press against one another in their at rest or closed position. Prongs 40 and 42 abut one another at lead contacting surfaces 50 and 54.

Figure 7:
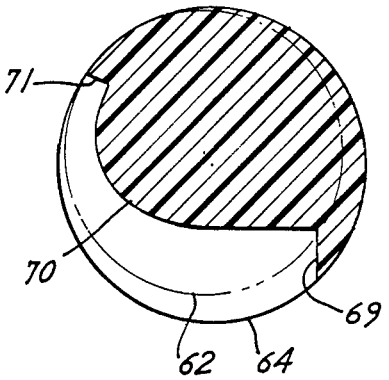
FIG. 7 is a sectional view taken along line 7—7 of FIG. 3.
Figure 8:
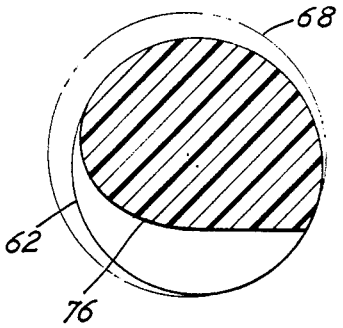
FIG. 8 is a sectional view taken along line 8—8 of FIG. 3.

Actuator 18 as shown in FIG. 3 includes arm 56 and integral camming rod 58 which is positioned substantially perpendicular to arm 56. Arm 56 includes handle portion 60 which is elevated for easier access to the user. Camming rod 58 includes a central cylinder body 62 and peripheral circular cam members 64, 66 and 68 which are of like periphery and eccentric to main cylinder body 62 as can be seen in FIGS. 7 and 8. Camming rod 58 also includes recessed cam surfaces 70 and 72 which are adjacent each side of cam 64 and recessed cam surfaces 74 and 76 which are adjacent each side of cam 66. Recessed cam surfaces 70, 72, 74, 76 are of like periphery, and as is shown in FIG. 7, both recessed cam surfaces 70 and 72 terminate in like positioned end walls. Referring to FIG. 8, it can be seen that cam surface 76 gradually tapers to its outer circumference as does can surface 74.

Figure 9:
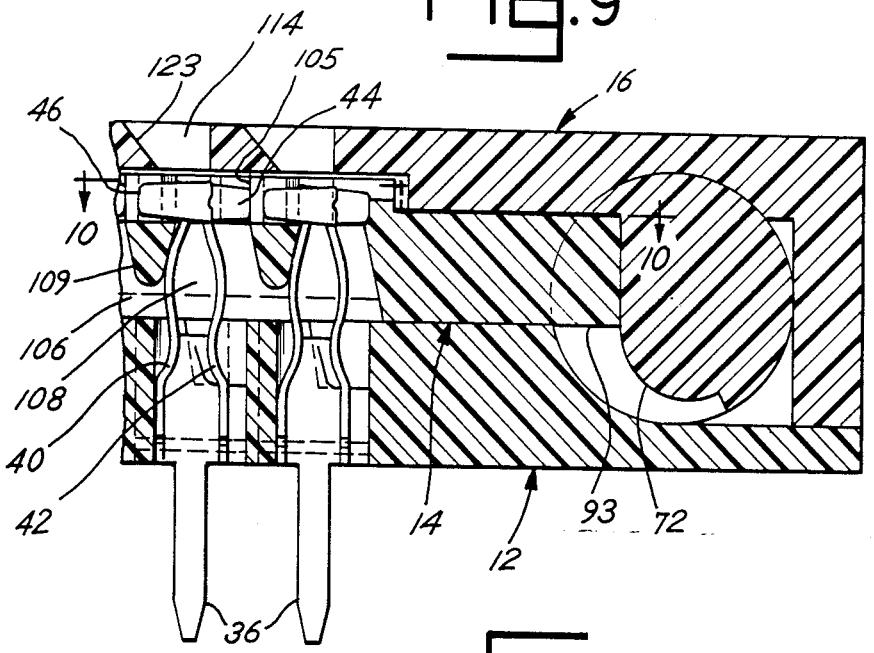
FIG. 9 is a fragmentary sectional view taken along line 9—9 of FIG. 4.
Figure 13:
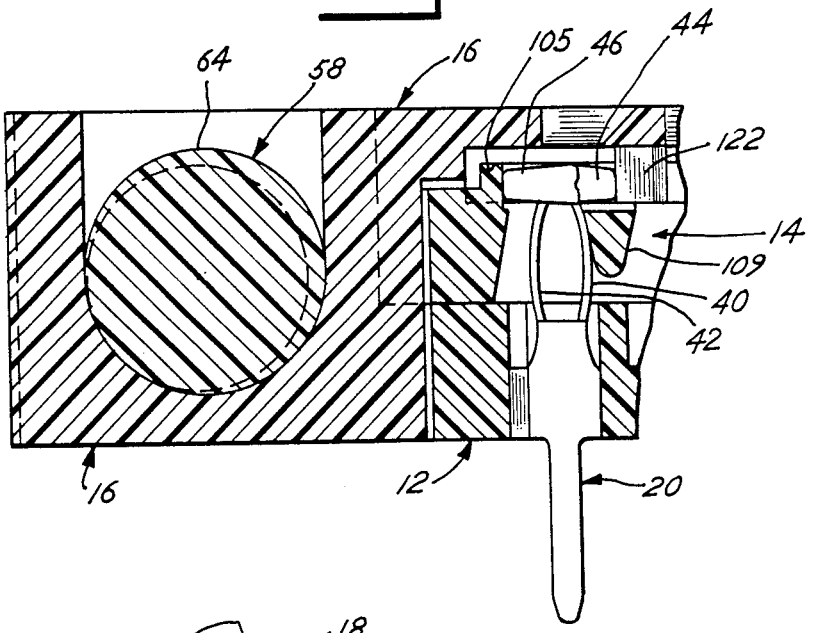
FIG. 13 is a fragmented sectional view taken along line 13—13 of FIG. 1.

FIG. 9 illustrates that in the closed position extension 93 of plate 14 abuts recessed cam surface 72. In a like manner, extension 92 abuts surface 70, extension 85 abuts surface 74 and extension 97 abuts surface 76. In this position, prongs 40, 42 are biased against one another due to their spring-like quality and, therefore, no force is exerted on members 12, 14 or 16. Thus the likelihood of stress related breakage or distortion of socket parts is minimized. FIG. 13 illustrates the orientation of cam 64 relative to top plate 16 while actuator 18 is in the closed position.

Figure 2:
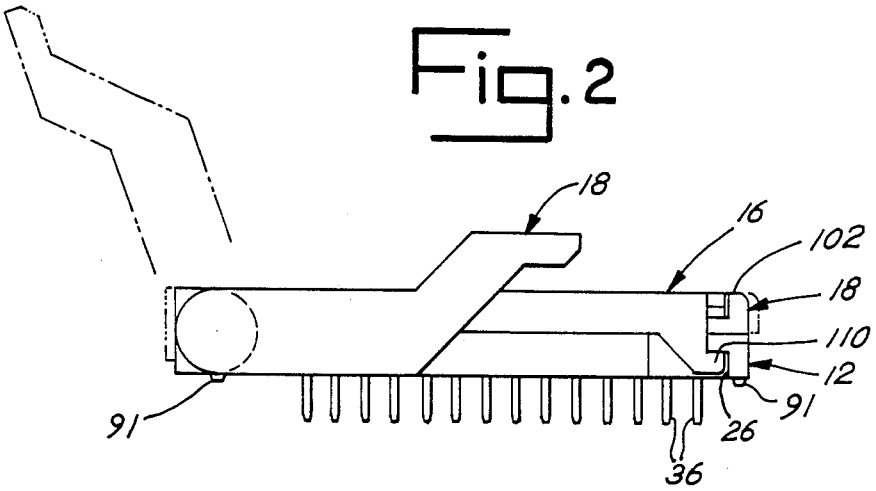
FIG. 2 is a side elevational view of the socket illustrating the relative shift between the top and middle plates upon the actuator arm being moved from its closed to open position.
Figure 14:
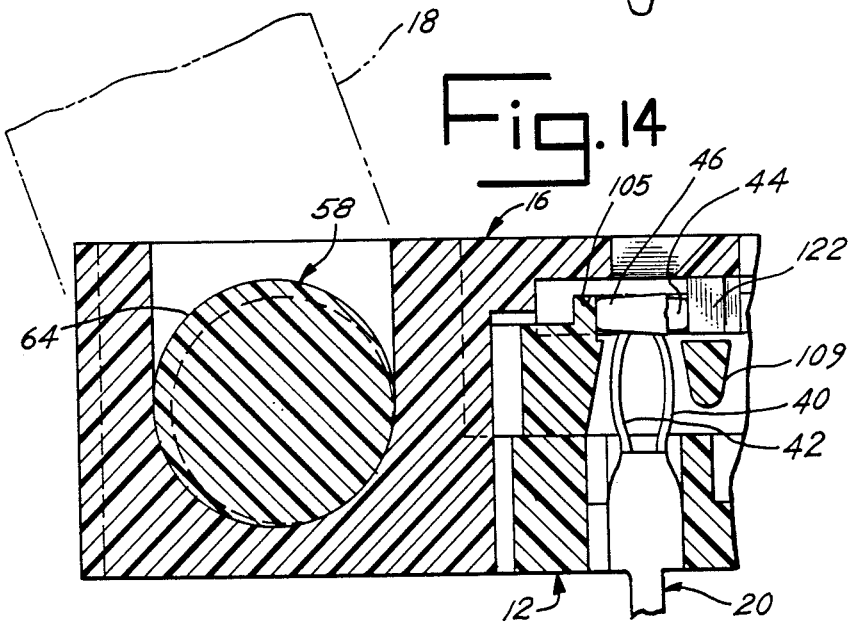
FIG. 14 is the sectional view of FIG. 13 with the socket in its open position.

To open prongs 40 and 42 for component lead insertion therebetween, the user lifts and rotates actuator 18 into the position shown in FIG. 2 by broken lines. Lifting actuator 18 causes camming rod 58 to rotate into the position shown in FIGS. 10 and 11. The recessed cam surfaces 70, 72, 74 and 76 press against their respective adjacent extensions 92, 93, 95, and 97 to urge plate 14 in the direction of arrow 125 in FIG. 11. Simultaneously, cams 64 and 66 are rotated and catch in squared openings 120 and 122 of supports 32 and 33 to urge plate 16 in the opposite direction as indicated by arrow 126. FIG. 14 illustrates the orientation of cam 64 relative to top plate 16 while actuator 18 is in the open position. As plate 14 and top 16 are so disposed, ledge 108 of plate 14 urges ear 44 of prong 42 in the direction of arrow 125 and ledge 122 of top 16 urges ear 46 of prong 42 in the direction of arrow 126. Thus, with prongs 40 and 42 urged in opposite directions, a component lead (not shown) may be inserted between lead contacting surfaces 50 and 54 of the prongs. Therefore, in the manner of component lead insertion described above, a component may be inserted downward into socket 10 without force and held in place without stress on members 12, 14 or 16.

Figure 5:
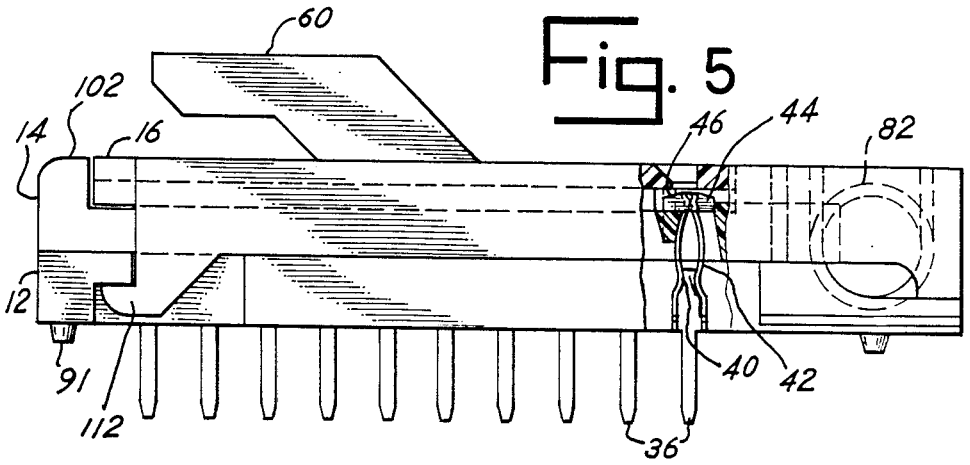
FIG. 5 is a side elevational view of the socket with portions cut away for illustrative purposes.

To close prongs 40 and 42 subsequent to a component lead being inserted therebetween, actuator 18 is moved into its original position shown in FIG. 2 in solid lines. Due to the spring quality of prongs 40, 42, the flexed prongs 40 and 42 close around and grasp the component lead for a secure mechanical and electrical connection. As each prong 40 springs toward its closed position, plate 14 is urged into its original position as shown in FIG. 5. Plate 16 is moved into its original position by cams 64 and 66 abutting the edges of squared openings 120 and 122. Therefore, the movement of plate 16 follows or is dependent upon cams 64 and 66 of camming rod 58.

It is understood that, although socket 10 is of a ten opening by ten opening pin grid array, the basic principles of this invention are applicable to any size or shape of socket, having any number or variety of holes to accommodate various leaded IC components.

It should be further understood that the invention is not limited to the precise form disclosed by the details above but may be modified within the scope of the appended claims.

I claim:

1. A socket adapted for securing an electrical component having leads to a conductor, said socket comprising three plate members each defining a multiplicity of openings therethrough, said plate members each adjacently overlying one another with said openings being vertically aligned, unitary contacts carried by the lowermost plate, each of said unitary contacts including a depending leg member and first and second upwardly projecting laterally spaced opposed prongs, each of said contact leg members extending below said lowermost plate member, each of said first and second contact prongs extending upwardly through the intermediate plate member into the uppermost plate member within said aligned openings, each of said prongs including a surface for contacting a component lead positioned between said first and second opposing contact prongs when said uppermost and intermediate plate members are in a first position, each of said prongs further including an ear member projecting from its said surface, first abutment means carried by said intermediate plate member for contacting said first contact prong ear member for urging each first contact prong away from said second opposing contact prong upon said intermediate plate member being shifted from said first position into a second position, second abutment means carried by said uppermost plate member for contacting said second contact prong ear member for urging each second contact prong away from said first opposing contact prong upon said uppermost plate member being shifted from said first position into a second position, wherein said first abutment means and said second abutment means are shiftable with their respective plate member in the same plane paralleling the intermediate plate member, camming means being shiftable from a first to a second position for shifting said uppermost and intermediate plate members from said first position and into said second positions relative to each other and said lowermost plate member, wherein said first and second opposing contact prongs are urged into an open position for said component lead insertion therebetween, said camming means being shiftable from its said second position into its said first position to allow said uppermost and intermediate plate members to shift from their said second positions into their said first position.

2. The socket of claim 1 wherein said first prong constitutes biasing means for urging said intermediate plate member into its said first position upon said camming means being rotated from its said second position into its said first position.

3. The socket of claim 1 wherein said camming means constitutes means for urging said uppermost plate member into its first position upon said camming means being rotated from its said second position into its said first position.

4. The socket of claim 1 and including a channel formed in said intermediate plate member and a corresponding rib formed on said lowermost member wherein said rib is slidably received within said groove to maintain alignment of said intermediate plate member and said lowermost member as said intermediate plate member shifts between its said first and second positions.

5. A socket adapted for securing an electrical component having leads to a conductor, said socket comprising three plate members each defining a multiplicity of openings therethrough, said plate members each adjacently overlying one another with said openings being vertically aligned, contacts carried by the lowermost plate, each of said contacts including a depending leg member and first and second upwardly projecting laterally spaced opposed prongs, each of said contact leg members extending below said lowermost plate member, each of said first and second contact prongs extending upwardly through the intermediate plate member and into the uppermost plate member within said aligned openings, each of said contacts being adapted to contact to component lead between said first and second opposing contact prongs when said uppermost and intermediate plate members are in a first position, first abutment means carried by said intermediate plate member for urging each first contact prong away from said second opposing contact prong upon said intermediate plate member being shifted from said first position into a second position, second abutment means carried by said uppermost plate member for urging each second contact prong away from said first opposing contact prong upon said uppermost plate member being shifted from said first position into a second position, camming means being shiftable from a first to a second position for shifting said uppermost and intermediate plate members from said first position and into said second positions relative to each other and said lowermost plate member, wherein said first and second opposing contact prongs are urged into an open position for said component lead insertion therebetween, said camming means being shiftable from its said second position into its said first position to allow said intermediate plate member to shift from its said second position into its said first position, said camming means constituting means for urging said upper most plate member into its first position upon said camming means being rotated from its said second position into its said first position.

* * * * *